US009217204B2

(12) United States Patent
Siljan et al.

(10) Patent No.: US 9,217,204 B2
(45) Date of Patent: Dec. 22, 2015

(54) CONTROL OF TEMPERATURE AND OPERATION OF INERT ELECTRODES DURING PRODUCTION OF ALUMINUM METAL

(75) Inventors: Ole-Jacob Siljan, Skien (NO); Stein Julsrud, Skien (NO)

(73) Assignee: NORSK HYDRO ASA, Oslo (NO)

( * ) Notice: Subject to any disclaimer, the term of this patent is extended or adjusted under 35 U.S.C. 154(b) by 1658 days.

(21) Appl. No.: 10/524,855

(22) PCT Filed: Aug. 15, 2003

(86) PCT No.: PCT/NO03/00280

§ 371 (c)(1),
(2), (4) Date: Jul. 19, 2005

(87) PCT Pub. No.: WO2004/018737

PCT Pub. Date: Mar. 4, 2004

(65) Prior Publication Data

US 2007/0000787 A1 Jan. 4, 2007

(30) Foreign Application Priority Data

Aug. 23, 2002 (NO) ..... 20024047

(51) Int. Cl.

| | |
|---|---|
| ***C25B 15/02*** | (2006.01) |
| ***C25B 9/00*** | (2006.01) |
| ***C25C 1/00*** | (2006.01) |
| ***C25C 3/06*** | (2006.01) |
| ***C25C 3/08*** | (2006.01) |
| ***C25C 3/20*** | (2006.01) |
| ***C25C 7/02*** | (2006.01) |
| ***C25C 7/06*** | (2006.01) |

(52) U.S. Cl.
CPC .... *C25C 3/08* (2013.01); *C25C 3/06* (2013.01)

(58) Field of Classification Search
CPC ..... C25B 1/00; C25B 9/00; C25B 11/00; C25B 15/02; C25C 1/00; C25C 3/06; C25C 3/08; C25C 3/00; C25C 7/02; C25C 7/06
USPC ..... 205/372, 334
See application file for complete search history.

(56) References Cited

U.S. PATENT DOCUMENTS

| | | | | |
|---|---|---|---|---|
| 1,521,002 | A * | 12/1924 | Brace | 204/225 |
| 4,678,548 | A | 7/1987 | Brown | |
| 4,737,247 | A | 4/1988 | Jarrett et al. | |
| 4,749,463 | A * | 6/1988 | Holmen | 204/241 |
| 6,344,131 | B1 * | 2/2002 | Nishino et al. | 205/640 |
| 2005/0000823 | A1 * | 1/2005 | Nguyen et al. | 205/380 |

* cited by examiner

*Primary Examiner* — Zulmariam Mendez
(74) *Attorney, Agent, or Firm* — Wenderoth, Lind & Ponack, L.L.P.

(57) ABSTRACT

The present invention relates to methods for operating and controlling the temperature of inert electrodes during production of molten aluminum by electrolysis of an aluminous ore, preferably alumina, dissolved in molten salts, preferably a fluoride based electrolyte, in an electrolysis cell with vertical or essentially vertical electrode configuration.

The invention describes methods of designing and operating inert electrodes in a vertical and/or inclined position for production of aluminum metal, where said electrodes have an operating temperature that may deviate from the electrolyte temperature, thereby controlling the dissolution of electrode materials and preventing solid deposit formation on the electrodes. The present invention is also applicable to aluminum production cells utilizing inert electrodes in a horizontal configuration, and traditional Hall-Hèroult cells retrofitted with inert anodes.

28 Claims, 7 Drawing Sheets

PRIOR ART

Fig. 1: Solubility of possible and assumed important inert anode components in molten cryolite melt as a function of temperature.

| | | | |
|---|---|---|---|
| Fe(II): | in Fe crucible. | Cu(I): | in Cu crucible |
| Ni(II): | in $O_2$ atmosphere | Cu(II): | in $O_2$ atmosphere |
| nat: | in cryolite without alumina | sat: | in cryolite, alumina saturated |

PRIOR ART

Fig. 2: Schematic representation of the cathode reaction in aluminium cells, assuming 100% current efficiency. Black arrows indicate current carriers.

PRIOR ART

Fig. 3: Concentrations (left hand scale) and local liquidus temperatures (right hand scale) as a function of the distance from the cathode (x-axis).

PRIOR ART

Fig. 4 Photograph of cathode deposits formed on a $TiB_2$ cathode during electrolysis of aluminium in cryolite-based electrolyte at 960°C for 48 hours.

CONTROL OF TEMPERATURE AND OPERATION OF INERT ELECTRODES DURING PRODUCTION OF ALUMINUM METAL

BACKGROUND OF THE INVENTION

Aluminium metal is presently produced by electrolysis of an aluminium containing compound dissolved in a molten electrolyte, and the electrowinning process is performed in smelting cells of conventional Hall-Hèroult design. These electrolysis cells are equipped with horizontally aligned electrodes, where the electrically conductive anodes and cathodes of today's cells are made from carbon materials. The electrolyte is based on a mixture of sodium fluoride and aluminium fluoride, with additions of alkaline and alkaline earth halides. The electrowinning process takes place as the current passed through the electrolyte from the anode to the cathode causes the electrical discharge of aluminium ions at the cathode, producing aluminium metal, and the formation of carbon dioxide on the anode (see Haupin and Kvande, 2000). The net reaction of the process can be illustrated by the equation:

$$2Al_2O_3+3C=4Al+3CO_2 \quad (1)$$

Due to the horizontal electrode configuration, preferred electrolyte composition and the use of consumable carbon anodes, the currently used Hall-Hèroult process display several shortcomings and weaknesses. The horizontal electrode configuration renders necessary an area intensive design of the cell and resulting in a low aluminium production rate relative to the footprint of the cell. The low productivity to area ratio results in high investment cost for green field primary aluminium plants.

Numerous attempts have been made to improve the currently used Hall-Hèroult process for production of aluminium metal. The improvements are aimed at cell design as well as electrode materials. One possible solution is the introduction of so-called inert electrodes, i.e. wettable cathodes (U.S. Pat. Nos. 3,400,036, 3,930,967 and 5,667,664) and oxygen evolving anodes (U.S. Pat. Nos. 4,392,925, 4,396,481, 4,450,061, 5,203,971, 5,279,715 and 5,938,914 and UK. Pat. No. 2 076 021 A). All of these patents are aimed at reducing the energy consumption during aluminium metal electrolysis through the implementation of so-called aluminium wettable cathode materials, as well as the removal of green house gasses from the electrolytic production of aluminium by applying oxygen-evolving anodes.

These "new" electrodes can be applied to both novel cell designs as well as in retrofitting of existing Hall-Hèroult cells. Patents regarding retrofit or enhanced development of Hall-Hèroult type of aluminium electrowinning cells are amongst others described in U.S. Pat. Nos. 4,504,366, 4,596,637, 4,614,569, 4,737,247, 5,019,225, 5,279,715, 5,286,359 and 5,415,742, as well as UK Pat. NO. 2 076 021 A. The major problem of the cell design suggested in these patents is, however, that the requirement for a large aluminium pool on the cell floor to provide electrical contact for the cathodes. This will render the cell susceptible to the influence of the magnetic fields created by the bus bar system, and may hence cause local short-circuiting of the electrodes when operating at short interpolar distances.

Novel cell designs for aluminium electrowinning are among others described in U.S. Pat. Nos. 4,681,671, 5,006,209, 5,725,744 and 5,938,914. Also U.S. Pat. Nos. 3,666,654, 4,179,345, 5,015,343, 5,660,710 and 5,953,394 describes possible designs of light metal electrolysis cells, although one or more of these patents are oriented towards magnesium production. Most of these cell concepts are applicable to multi-monopolar and bipolar electrodes.

Other Publications:

Haupin, W. and Kvande, H.: "*Thermodynamics of electrochemical reduction of alumina*", Light Metals 2000, pp. 379-384, 2000.

Lorentsen, O- A.: "*Behaviour of nickel, iron and copper by application of inert cathodes in aluminium production*", Dr. Ing. thesis 2000/104, Norwegian University of Science and Technology, Trondheim, Norway, 2000.

Lorentsen, O- A. and Thonstad, J.: "*Laboratory cell design considerations and behaviour of inert cathodes in cryolite-alumina melts*", 11th International Aluminium Symposium, Slovak—Norwegian Symposium on Aluminium Electrowinning, September 19-22, Norway, pp. 145-154, 2001.

McMinn, C., Crottaz, O., Bello, V., Nguyen, T. and deNora, V.: "*The development of a metallic anode and wettable cathode coating and their tests in a 20-kA prototype drained cell*", Light Metals, 2002.

Solheim. A.: "*Formation of solid deposits at the liquid cathode in Hall-Hèroult cell*", International Aluminium Symposium, Slovak—Norwegian Symposium on Aluminium Electrowinning, September 19-22, Norway, pp. 97-104, 2001.

Solheim. A.: "*Crystallization of cryolite and/or alumina nay lake place at the cathode during normal cell operation*", Light Metals 2002, pp. 3 225-230, 2002

Operating Oxygen Evolving, Inert Anodes:

With inert anodes in the electrowinning of aluminium oxide, the net reaction would be:

$$2Al_2O_3=2Al+3O_2 \quad (2)$$

So far, no commercial scale electrolysis cells have been operated successfully over longer periods of time with inert anodes. Many attempts have been made to find the optimum inert anode material and the introduction of these materials in electrolytic cells. Proposed materials for inert anodes in aluminium electrolysis includes metals, oxide-based ceramics as well as cermets based on a combination of metals and oxide ceramics. The proposed oxide-containing inert anodes may be based on one or more metal oxides, wherein the oxides may have different functions, as for instance chemical "inertness" towards cryolite-based melts and high electrical conductivity (ex. U.S. Pat. Nos. 4,620,905 and 6,019,878). The proposed differential behaviour of the oxides in the harsh environment of the electrolysis cell is, however, questionable (see McMinn et al. (2002)).1. The metal phase in the cermet anodes may likewise be a single metal or a combination of several metals. The main problem with all of the suggested anode materials is their chemical resistance to the highly corrosive environment due to the evolution of pure oxygen gas (1 bar) and the cryolite-based electrolyte. To reduce the problems of anode dissolution into the electrolyte, additions of anode material components to saturate the electrolyte with anode components (U.S. Pat. No. 4,504,369) and a self generating/repairing mixture of cerium based oxy-fluoride compounds (U.S. Pat. Nos. 4,614,569, 4,680,049 and 4,683,037) have been suggested as possible inhibitors of the electrochemical corrosion of the inert anodes. However, none of these systems have been demonstrated as viable solutions.

When operating cells with inert anodes, one major and often prohibitive problem is the accumulation of anode material elements in the produced aluminium metal due to the electrochemically assisted dissolution of the anode material in the electrolyte. Several patents have tried to address this problems by suggesting a reduction in the cathode surface (U.S. Pat. Nos. 4,392,925 and 4,681,671), i.e. the surface of the produced aluminium metal. Reduced aluminium metal surface exposed to electrolytic bath will reduce the uptake of dissolved anode material components in the metal, and hence increase the durability of the oxide-ceramic (or metals and cermets) anodes in the electrolysis cells. This is amongst others described in U.S. Pat. Nos. 4,392,925, 4,396,481, 4,450,061, 5,203,971, 5,279,715 and 5,938,914 and in UK. Pat. No. 2 076 021 A.

During electrolysis of aluminium metal, heat is generated in the process. In the traditional Hall-Hèroult cells, as well as in any novel design cells, heat will be generated due to the electrical resistance of the current bearing components of the cell. The major heat generating materials/components will be the anode and the electrolyte. The heat generation in the anode is dependent on the electrical conductivity of the anode materials, and the heat generation in the electrolyte will depend on the electrolyte composition and the distance between the anode and the cathode ion the cell, i.e. the interpolar distance (ACD). It is a well known fact that most materials/anode components will have a decreased solubility in molten cryolite based electrolyse as the temperature of the bath decreases. Hence, another and yet more feasible route to suppress metal contamination, would be to reduce the dissolution of the anode components in the electrolyte by reducing the anode temperature and or the electrolyte temperature. As presented in patent number WO 01/31090, the most recent inert anode materials may consist of mixtures of NiO and FeO with metallic additions of Cu, in which some Cu metal may be oxidised during sintering and/or electrolytic operation to form CuO. As indicated in FIG. 1, based on data collected from Lorentsen (2000), it is obvious that the major inert anode material components will exhibit a decreased solubility as the temperature decrease. By arranging the electrodes and cell design in order to keep the anodes as the coldest part of the cell interior, the dissolution rates into the bath will be reduced. If the anode is mainatined at a temperature slightly lower than the electrolyte, there will be a thermal impetus for depositing dissolved anode material on the anode itself rather than on the surrounding structure elements of the cell, i.e. the dissolution of anode material components will be suppressed.

U.S. Pat. No. 4,737,247 propose the use of heat pipes embedded in the anode current conductor rod (anode stem). The main purpose of the heat pipes in the sited patent is to protect some of the structural elements of the inert anode assembly, i.e. the spacer, from chemical erosion by molten electrolyte, by assuring the formation of a protective layer of frozen bath around these structural elements. The heat pipes are, however, not designed to keep the anode surface colder than the electrolyte, and as such reduce the dissolution of anode material in the electrolyte.

Operating Aluminium Wetted Cathodes:

Inert, or wettable cathodes are usually proposed manufactured from so-called Refractory Hard Materials (RHM) like borides, nitrides and carbides of the transition metals, and also RHM silicides are proposed as useful as inert cathodes (U.S. Pat. Nos. 4,349,427, 4,376,690 and 2001/0020590). The RHM cathodes are readily wetted by aluminium metal and hence a thin film of aluminium metal may be maintained on the cathode surfaces during aluminium electrowinning in drained cathode configurations. This wetting of the cathodes is the key to successful operation of the wetted cathodes, especially if the cathodes are employed in a vertical or tilted/sloped design geometry. Under these circumstances it is essential that the produced aluminium metal is drained off the cathode and not allowed to accumulate in the interpolar space and thus enabling the cell or parts of the cell to short circuit.

Solheim (2001) addressed the problem of formation of solid deposits at the cathode during electrolysis. Solids depositions at the cathode during electrolysis is caused by precipitation and adherence of bath components, often infiltrated with a metal phase. When aluminium electrolysis takes place, aluminium is formed at the cathode surface. Because of the migration of sodium ions, as current carriers, also towards the cathode, the cryolite ratio of the bath at the cathode surface (i.e. catholyte) will decrease compared to the bulk electrolyte (Solheim, 2001), as illustrated in FIG. 2. As a result of this change of bath composition, the liquidus temperature of the catholyte will be different from the liquidus temperature of the bulk bath, and hence under given conditions solid deposits of cryolite and/or alumina may form at the cathode, as is illustrated in FIG. 3. This has been confirmed experimentally in a laboratory scale cell with inert electrodes, as reported by Lorentsen (2000) and is shown in FIG. 4. The rate of formation of the solid deposits is dependent on, amongst others, bath composition (cryolite ratio), bath temperature, superheat, alumina concentration and cathodic current densities.

The formation of solid deposits on the cathode may grow once formed and percolate the continuous aluminium film on the drained cathodes, hence accounting for electrical passivation of the cathode are as well as promoting the growth of large aluminium balls on the cathode surface. Due to the lack of or reduced wetting of aluminium on the cathode surface caused by the solid deposits, the aluminium balls (spheres) will continue to grow under cathodic polarisation and may eventually short circuit the cell or parts of the cell when reaching the adjacent cathode surface.

OBJECTS OF THE PRESENT INVENTION

It is the object of the invention to provide means for controlling and maintaining the designed electrode temperatures in order to facilitate the production of aluminium metal by the electrowinning of aluminous ore, preferably aluminium oxide, in a molten fluoride electrolyte, preferably based on cryolite, at temperatures in the range 680-980° C. by the use of inert electrodes, such as wettable cathodes and oxygen evolving anodes. Controlling and maintaining desired electrode temperatures is essential with regard to obtaining optimum capacity of the electrolysis cell, through keeping the cathode surfaces free from solid deposits and through preventing excessive dissolution rates of anode materials and hence undesired metal contamination. By maintaining a thin film of liquid metal on the cathode surface, rather than forming spheres due to partial passivation on the account of solid deposits formation, will also reduce the surface area of the metal exposed to molten electrolyte and as such decrease the metal contamination with dissolved anode components.

The present invention applies to all inert anodes and cathodes, both vertical and horisontal as wells as tilted or inclined electrodes. Therefore the principles of the present invention can be applied to both novel cell designs as wells as cells of the traditional Hall-Hèroult design with inert anodes (retrofitting). In future advanced cells with bipolar electrode design, the same governing design principles with respect to electrode temperatures can be employed.

Said invention is designed to overcome problems related to solid deposits formation on the cathodes and excessive dissolution of anode components into the molten electrolyte. Controlling these mechanisms will help to maintain a fixed ACD during electrolysis, stabilise current and voltage distribution in the electrodes and bring about reduced contamination of the produced metal, thus providing an improved commercial and economically viable process for said aluminium production.

Figure 1:
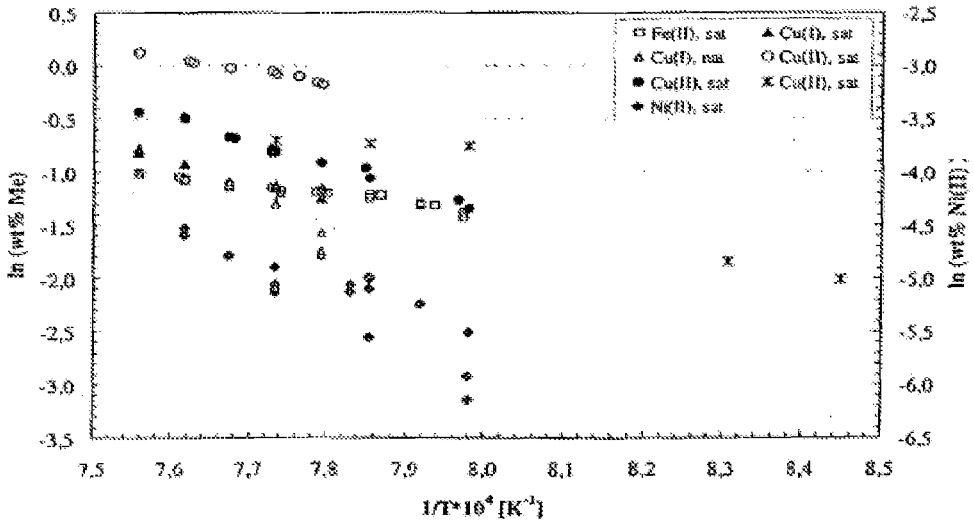
FIG. 1 shows the solubility of some important inert anode components in molten cryolite melt as a function of temperature. Data from Lorentsen (2000).
Figure 2:
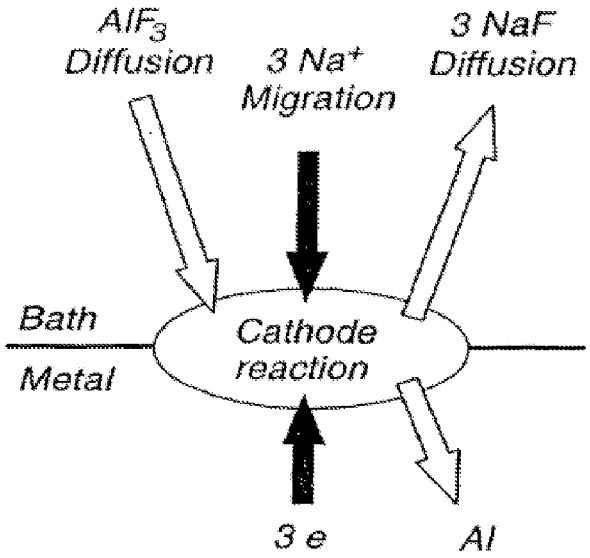
FIG. 2 shows the migration of ions in the electrolyte causing a change in the $NaF/AlF_3$-ratio near the cathode surface. From Solheim (2001).
Figure 3:
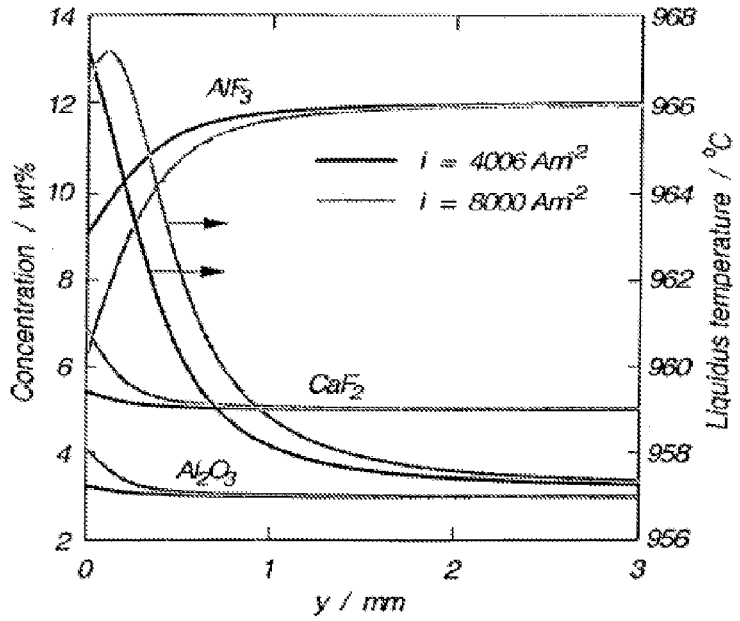
FIG. 3 shows concentration profiles of important electrolyte constituents as a function distance from the cathode. From Solheim (2002).
Figure 4:
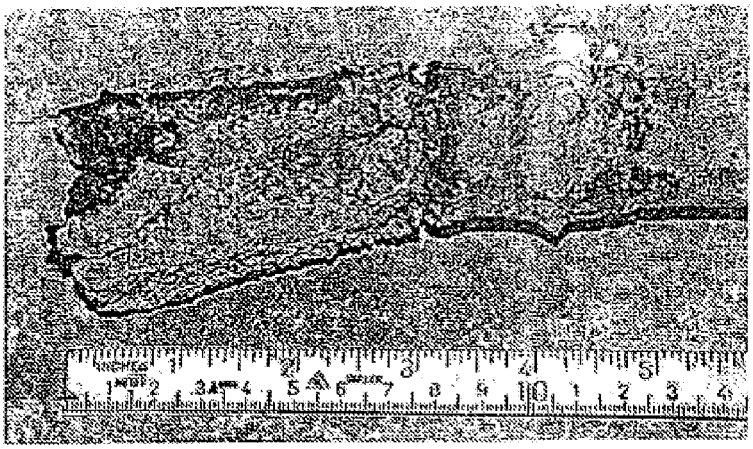
FIG. 4 shows a photograph of cathode deposits formed on a $TiB_2$ cathode during electrolysis of aluminium in cryolite-based electrolyte at 960° C. for 48 hours. From Lorentsen (2001).
Figure 5:
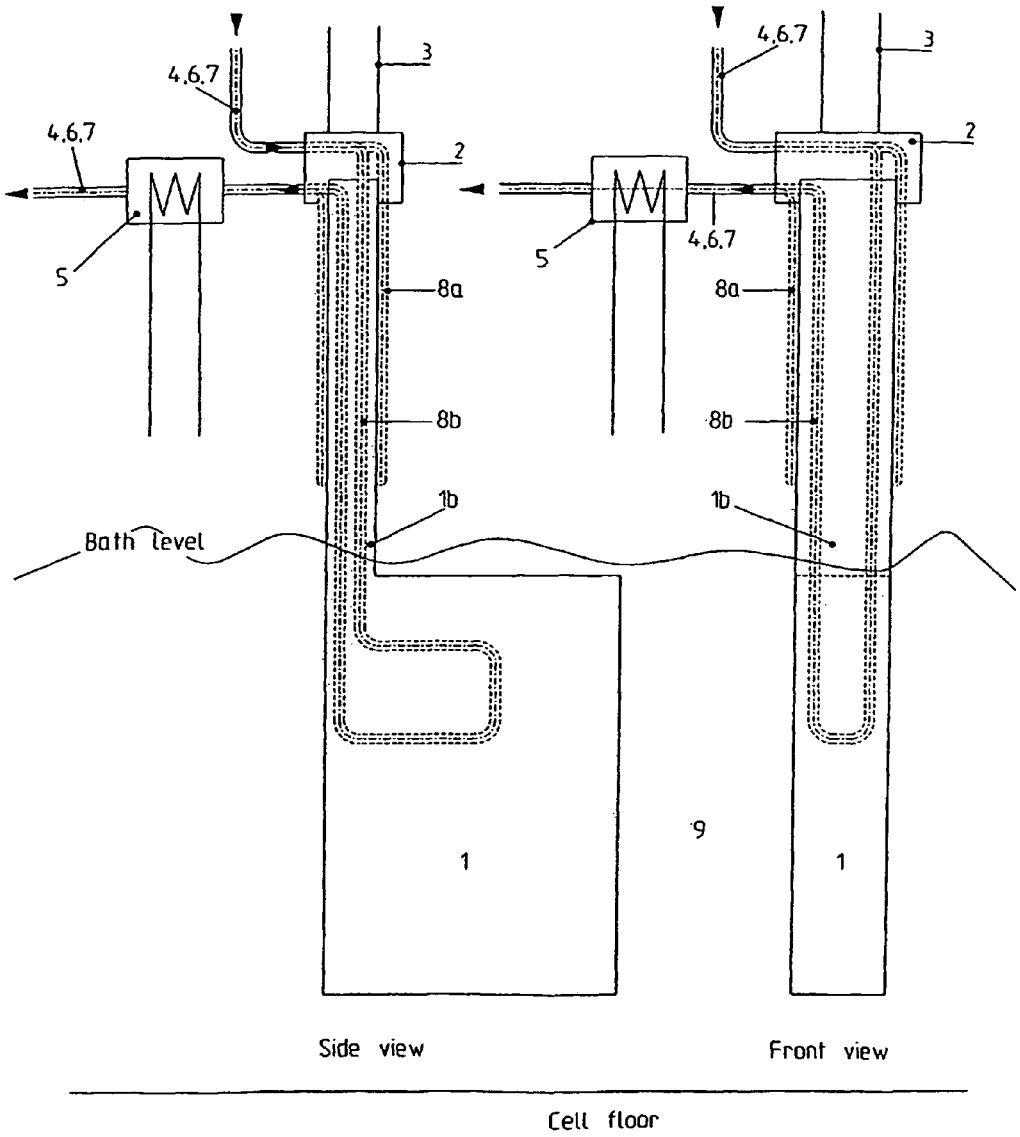
FIG. 5 shows one embodiment of the present invention related to controlling and maintaining desired electrode temperatures on oxygen-evolving, essentially inert anodes for aluminium electrolysis.
Figure 6:
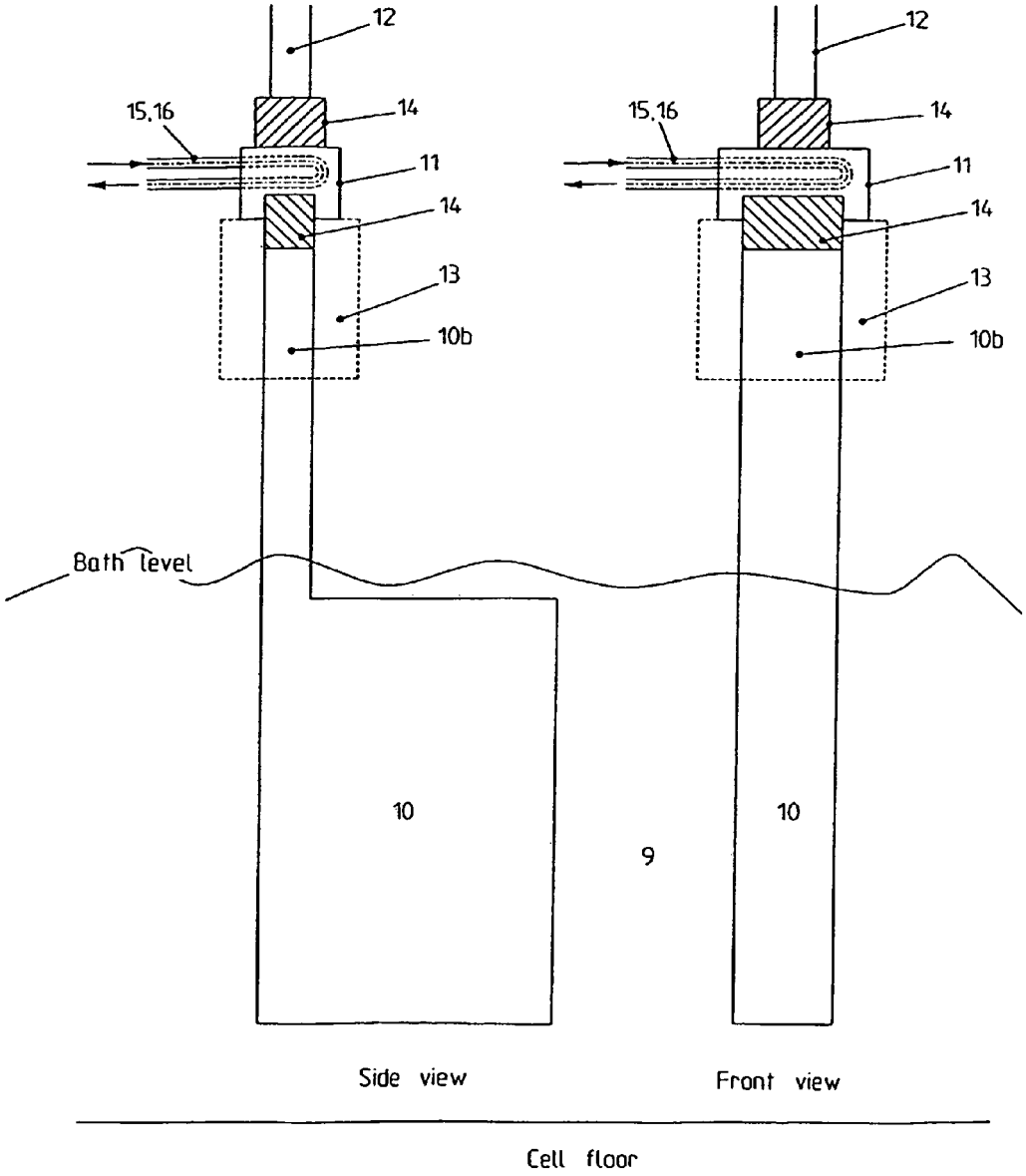
FIG. 6 shows one embodiment of the present invention related to controlling and maintaining desired electrode temperatures on wettable cathodes for aluminium electrolysis.
Figure 7:
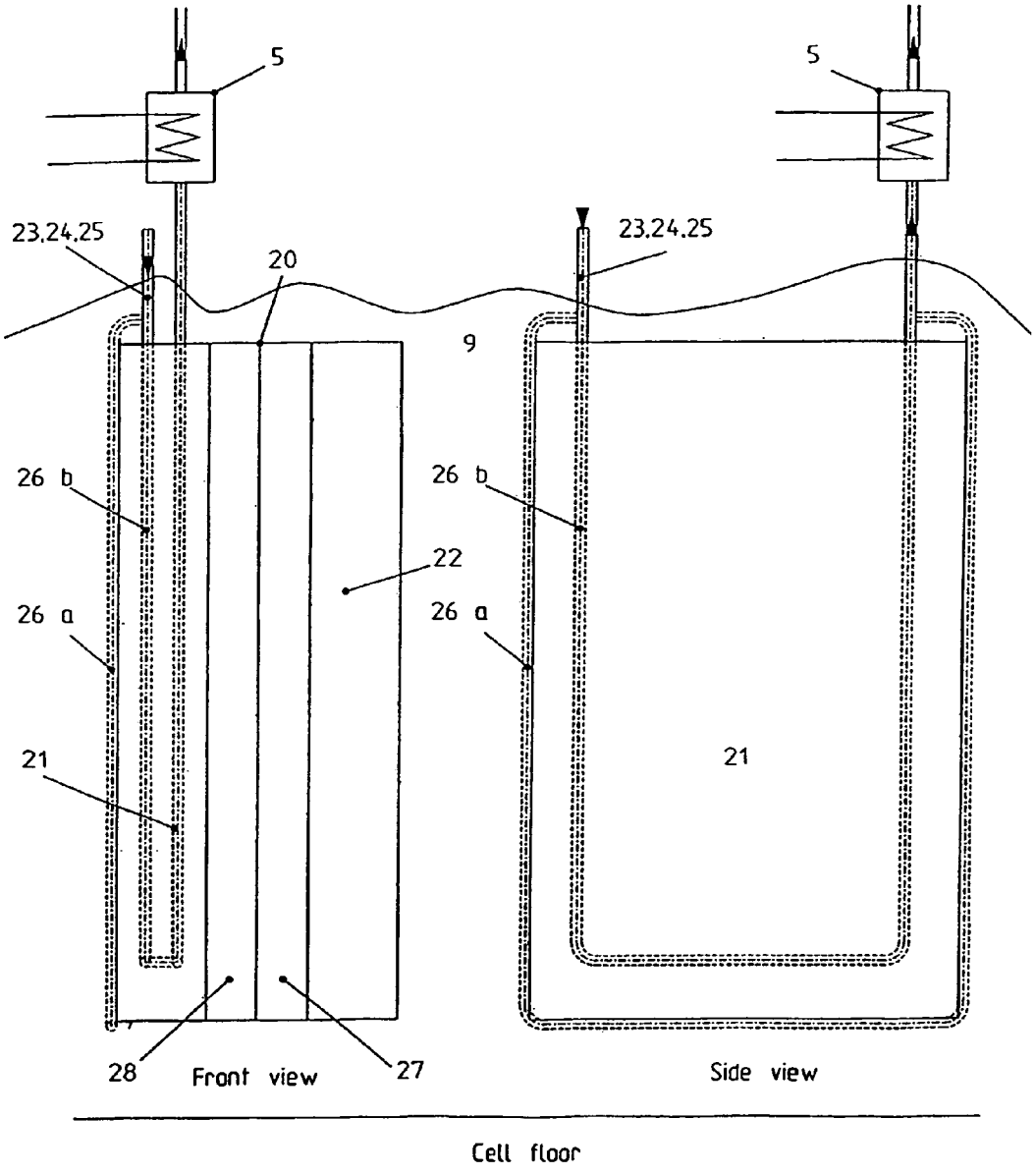
FIG. 7 shows one embodiment of the present invention related to controlling and maintaining desired electrode temperatures in bipolar electrodes for aluminium electrolysis.

The suggested electrode designs and temperature controlling mechanisms as presented in FIGS. 5 through 7 represents only one particular embodiment of said invention which may be used to perform the method of electrolysis according to the invention.

DETAILED DESCRIPTION OF THE INVENTION

A governing principle in the present invention relates to the design, control and maintenance of desired electrode temperatures during the electrolysis of aluminium by utilisation of essentially inert electrodes in a sodium fluoride-aluminium fluoride-based electrolyte. The suppression of material dissolution rates from the oxygen-evolving anodes and the impediment of solid deposit formation on the wettable cathodes can be accomplished through the use of structural design elements and design principles, some of which are known to those skilled in the art.

In the subsequent description all number references (#) sited in the text are related to the numbering used in FIGS. 5 through 7.

Controlling Anode Temperature:

A vertically aligned or vertically inclined, oxygen-evolving anode (1), see FIG. 5, based on oxides, metals, cermets or mixtures thereof will have a certain solubility in the electrolyte. The principles of controlling the anode temperature is an essential aspect of performing aluminium electrolysis with the use of essentially inert anodes. There are two major aspects here, namely controlling the inert anode (1) temperature to control the dissolution of anode material in the electrolyte and the controlling of the temperature in the electrical connection (2) between the anode material (1) and the current lead (3). The current leads and the electrical connections can be made of almost any electrically conductive materials, although metals are the preferred material due to their superior conductivity, ductility and reasonable strengths even at elevated temperatures. In the present invention, temperature control of the anode as well as the electrical connections can be obtained in several ways as described below.

The vertically aligned or inclined anode may have an anode stem between the submerged anode and the electrical connection, said stem having a cross sectional ratio to the anode cross section area of at least 0.005-0.5.

Heat pipes (4) can be used to extract heat from the anodes. The extracted heat can be used for energy recovery (5), for instance in the form of steam or hot water. The heat pipes (4) can be connected to (8*a*) or imbedded in (8*b*) the inert anode. The amount of energy (heat) removal required for the maintaining of the proper electrode temperature will determine the dimensions of the heat pipes. The use of sodium metal represents one of several options with respect to the heat transfer media utilised in the heat pipes (4).

Water-cooling (6), or the use of other liquid coolants as heavy alcohols, oils, synthetic oils, mercury, molten salts, etc., can also be used for the purpose of cooling the inert anodes. Again, the generated heat can be used for energy recovery (5), for instance in the form of steam or hot water. The cooling liquid flow-channels can be connected to (8*a*) or imbedded in (8*b*) the inert anode. The amount of energy (heat) removal required for the maintaining of the proper electrode temperature will determine the necessary cooling capacity of the system.

Gas-cooling (7), using compressed air, nitrogen, argon, helium, carbon dioxide, ammonia and/or other suitable gases, is an optional choice of cooling media. As is the case with cooling liquids, the generated heat can be used for energy recovery (5), for instance in the form of steam, hot water or as electric current. The regeneration of extracted heat as electric current may be obtained by the use of steam turbines or sterling motors. Due to the low heat transfer coefficients between solid and gas, the area of the flow-channels (8*a,b*) and the heat exchanger unit (5) will usually be larger when gas-cooling is applied compared to heat pipes (4) or liquid cooling (6). The amount of energy (heat) removal required for the maintaining of the proper electrode temperature will determine the necessary cooling capacity of the system.

The inert anodes (1) can also be cooled by simple mechanical means of design. When cermet or metallic inert anodes are used, these materials have high electrical and, hence, high thermal conductivity. The current leads connecting the inert anodes to the anode bus-bar system may then be used to extract heat from the anodes and "deliver" this energy/heat to the surroundings. If the electric current leads (3) have a large cross section, and/or if the anode stem (1*b*) have a large cross section, the anode will be cooled simply by heat transfer through the current leads and/or the anode stem. By calculating the heat transfer in the anode stem and current leads, these components can be dimensionally designed to maintain a certain temperature in the anode. This temperature is desirably somewhat lower that the temperature of the electrolyte (9).

The same methods and principles of cooling can also be utilised for oxygen-evolving anodes applied to existing Hall-Hèroult cells.

The cooling medium in the heat pipes can be selected among the elements sodium, potassium, cadmium, caesium, mercury, rubidium, sulphur, iodine, astatine and/or selenium. The cooling medium may also be selected from the compounds of heavy metal halides, for instance zirconium fluoride, thallium mono chloride, thallium fluoride, thallium iodide, lead iodide, lead chloride, lead bromide, iron iodide, indium chloride, calcium bromide, cadmium bromide and/or cadmium iodide. The cooling medium can also be aluminium fluoride (pressurised).

The vertically aligned or inclined oxygen-evolving anode can be attached to the electrical conductor system through an electric connection, said connection being cooled by means of heat pipes, liquid cooling and/or gas cooling.

Said cooling methods may involve suitable coolants adapted to the different methods, such as sodium metal for heat pipes, water, heavy alcohols, oils, synthetic oils, mercury and/or molten salts for liquid cooling and/or compressed air, nitrogen, argon, helium, carbon dioxide, ammonia and/or other suitable gasses for gas cooling. Said cooling of electrical connection can be obtained by using an highly electrical conductive metal with a large cross sectional are, said area being at least 1.1-5.0 times the cross sectional area of the anode stem cross sectional area.

Regarding electrolysis cell having horizontal electrode configuration, following coiling medium can be applied:

Where the cooling medium in the heat pipes is selected among the elements sodium, potassium, cadmium, caesium, mercury, rubidium, sulphur, iodine, astatine and/or selenium, and where liquid coolants can be water, heavy alcohols, oils, synthetic oils, mercury and/or molten salts, and where gas cooling medium is compressed air, nitrogen, argon, helium, carbon dioxide, ammonia and/or other suitable gases, and where the cooling methods involved are using suitable coolants adapted to the different methods, such as sodium metal for heat pipes, water, heavy alcohols, oils, synthetic oils, mercury and/or molten salts for liquid cooling and/or compressed air, nitrogen, argon, helium, carbon dioxide, ammonia and/or other suitable gasses for gas cooling.

The cooling of electrical connection can be obtained by using an highly electrical conductive metal with a large cross sectional are, said area being at least 1.1-5.0 times the cross sectional area of the anode stem cross sectional area. The horizontally aligned or inclined anode can have an anode stem between the submerged anode and the electrical connection, said stem having a cross sectional ratio to the anode of at least 0.005-0.5.

The electrolyte in the cell may comprises a mixture of sodium fluoride and aluminium fluoride, with possible additional metal fluorides of the group 1 and 2 elements in the periodic table according to the IUPAC system, and the possible components based on alkali or alkaline earth halides up to a fluoride/halide molar ratio of 2.5, and where the NaF/$AlF_3$ molar ratio is in the range 1 to 4, preferably in the range 1.2-2.8.

Controlling Cathode Temperature:

A vertically aligned or vertically inclined, aluminium wettable cathode (10), see FIG. 6, based on RHM borides, nitrides or carbides, or mixtures thereof, will have a certain solubility in the electrolyte. Additionally, the essentially inert cathode will, due to its high electric conductivity act as a very good heat conductor, and as such contribute to the cooling of the cathode. However, if the heat losses from the cathode is not controlled, the cold cathode surface may be subjected to deposit formation of cryolite and/or alumina. The principles of controlling the cathode temperature is an essential aspect of performing aluminium electrolysis with the use of essentially inert cathodes. Again, there are two major aspects here, namely controlling the inert cathode (10) temperature to control the formation of solid deposits on the cathode and controlling the temperature in the electrical connection (11) between the cathode material (10) and the current lead (12). In the present invention, temperature control of the cathode as well as the electrical connections can be obtained in several ways as described below.

In order to prevent formation of solid deposits at the cathode, it is essential to keep the cathode at the same temperature or preferably at a slightly higher temperature than the surrounding electrolyte (9). This can be obtained in several ways, including the use of thermal insulation (13), heat generating intermediate electrical current lead (14), limiting the cross section of the cathode stem (10*b*) and/or adjusting the specific cathode surface area (10). By careful selection of the insulation materials surrounding the cathode stem (10*b*), the horisontal heat losses from the cathode assembly can be reduced. However, this insulation may under certain conditions not sufficiently reduce the heat losses from the highly heat conductive cathode (10), and the introduction of an intermediate electrical current lead (14) to supply extra local heat and thereby suppress the heat flow out of the cathode may be introduced. This intermediate electrical current lead (14) made be manufactured from dense oxidation resistant graphite material or metals and/or metal alloys such as stainless steel, Incoloy, Hastaloy, etc.

Also by reducing the cross section of the cathode stem (10*b*) the heat flow from the cathode can be reduced to appropriate levels for maintaining a high cathode surface temperature. Likewise, a reduction in the cathode surface area (10), assuming unchanged current load to the cell, will increase the current density on the cathode and thereby increasing the heat generated in the cathode. The cathode surface area (10) can the be designed in a manner to maintain a higher temperature of the submerged cathode than in the surrounding electrolyte (9) and thereby preventing formation of solid deposits on the cathode.

The electrical connections (11) to the wettable cathodes (cathode stem, 10*b*) must be kept at a temperature low enough to prevent oxidation of the connecting surfaces, and yet at a temperature high enough to prevent excessive heat losses and cooling of the cathode surface (10). The desired cooling and temperature control of the electric connections (11) between the cathode (10) and the current leads (12) can be obtained by means of water-cooling (15) or the use of other liquid coolants as heavy alcohols, alcohols, oils, syntetic oils, mercury, and/or molten salts, etc. for liquid cooling, use of gas-cooling (16), using compressed air, nitrogen, argon, helium, carbon dioxide, ammonia and/or other suitable gases for gas cooling, or simply by using a large area on the electrical connections (11). However, it is essential that the designed cooling effect of the cathode connections (11) is harmonised with the desired temperature maintenance of the submerged cathode (10).

The vertically aligned or inclined wettable cathode can be maintained at a temperature at least at the same level as the electrolyte, preferably slightly higher, where the temperature is obtained by reducing the cross sectional area of the submerged cathode compared to the submerged anode area, said cathode area being 0.5-1.0 times the cross sectional area of the submerged anode. The vertically aligned or inclined cathode can have a cathode stem between the submerged cathode and the electrical connection, said cathode stem area being 0.005-0.5 times the cross sectional area of the submerged cathode.

The cooling of electrical connection can be obtained by using an highly electrical conductive metal with a large cross sectional are, said area being at least 1.1-5.0 times the cross sectional area of the cathode stem cross sectional area. The vertically aligned or inclined cathode may have a cathode stem between the submerged cathode and the electrical connection, said stem having a cross sectional ratio to the cathode of at least 0.005-0.05.

Controlling Temperature of Bipolar Electrodes:

A vertically aligned or vertically inclined, bipolar electrode (20) can be viewed upon as a plate functioning as an anode (21) on one side and a cathode (22) on the opposite side. If essentially inert electrode materials are used, the anode will be oxygen-evolving and the cathode will be aluminium wettable. The anode (21) may be based on oxides, metals, cermets or mixtures thereof, and the cathode (22) can be based on RHM borides, nitrides, carbides or mixtures thereof. As outlined previously, all of these materials will have a certain solubility in the electrolyte, and for the cathode also prevention of solid deposit formation is a matter of interest. The principles for controlling the electrode temperature is an essential aspect of performing aluminium electrolysis with the use of essentially inert electrodes aligned vertically or inclined. In a bipolar electrode, the main problem is to keep the anode (21) colder than and the cathode (22) at the same temperature or at a slightly higher temperature than the surrounding electrolyte (9). Additionally, for the terminal electrodes (anode+cathode), the same principles and means of temperature control as described above may be applied.

Due to the coupling of an anode (21) and a cathode (22) in a plate-like shape to form the bipolar electrode (20), difficulties arise in controlling and maintaining the appropriate electrode temperatures. The high electric conductivity of the electrode materials, renders it almost impossible to maintain a large temperature gradient in the submerged bipolar electrode. The anode (21) can be cooled by heat-pipes (23), liquid cooling (24) or gas cooling (25), with the cooling tubes (devices) connected to (26*a*) or embedded in (26*b*) the anode, preferably located in the circumference of the active anode surface. Applicable cooling agent for these designs are described earlier in the text. The extracted heat from the anode can be used for energy recovery (5), for instance in the form of steam, hot water or electric current. The latter can be obtained by the use of sterling motors. The cathode (22) can be maintained at the same temperature or at a slightly higher temperature than the surrounding electrolyte (9) by reducing the active cathode surface (22) or by means of inserting a layer of a less conductive material (27) between the cathode material and the anode material, thereby initiating a resistance heating of the cathode. Additionally the bipolar electrode may consist of one ore more intermediate layers separating the oxygen-evolving anode (21) and the wettable cathode (22).

Said cooling methods may use suitable coolants adapted to the different methods, such as sodium metal for heat pipes, water, heavy alcohols, oils, synthetic oils, mercury and/or molten salts for liquid cooling and/or compressed air, nitrogen, argon, helium, carbon dioxide, ammonia and/or other suitable gasses for gas cooling.

The cathode of the bipolar electrode may be heated by means of reducing the active surface area of the cathode so that the bipolar electrode has a cathode to anode surface area ratio of at least 0.5-1.0.

The invention claimed is:

1. A method for electrolytic production of aluminium metal, said method comprising performing electrolysis on an electrolyte comprising aluminium oxide in a molten fluoride electrolyte at a temperature in a range of 680° C. to 980° C. in an electrolysis cell containing at least one electrolysis chamber with at least one essentially inert anode aligned vertically or vertically inclined and at least one wettable cathode aligned vertically or vertically inclined, and/or at least one bipolar electrode containing both anode and cathode, where the anode evolves oxygen gas and the cathode has aluminium discharged thereonto in the electrolysis process, the oxygen gas enforcing an electrolyte flow pattern upward and the produced aluminium flowing downward due to gravity, controlling and maintaining the temperature of an electronic active surface of each of the anode and the cathode independently of each other and further at a level different from the level of the surrounding electrolyte by active or passive cooling and/or active or passive heating, and controlling a temperature of the surrounding electrolyte independently from said controlling and maintaining of the temperature of the electronic active surface of each of the anode and the cathode, so as to allow a dissolution of the aluminium oxide in the electrolyte to be optimized, while limiting a dissolution of the anode in the electrolyte and preventing a formation of solid deposits at the cathode, wherein the temperature of the active surface of the anode is colder than the temperature of the active surface of the cathode.

2. A method in accordance with claim 1, wherein the vertically aligned or inclined oxygen-evolving anode is actively cooled by the use of at least one or more heat pipes embedded in and/or connected to the anode and/or the anode stem.

3. A method in accordance with claim 2, wherein the cooling medium in the heat pipes is selected among the elements sodium, potassium, cadmium, caesium, mercury, rubidium, sulphur, iodine, astatine and/or selenium, or from the compounds of heavy metal halides, for instance zirconium fluoride, thallium mono chloride, thallium fluoride, thallium iodide, lead iodide, lead chloride, lead bromide, iron iodide, indium chloride, calcium bromide, cadmium bromide and/or cadmium iodide or aluminium fluoride (pressurized).

4. A method in accordance with claim 1, wherein the vertically aligned or inclined oxygen-evolving anode is actively cooled by the use of at least one or more flow-channels embedded in and/or connected to the anode and/or the anode stem, the flow-channels carrying and circulating liquid coolants.

5. A method in accordance with claim 4, wherein the liquid coolants are water, heavy alcohols, oils, synthetic oils, mercury and/or molten salts.

6. A method in accordance with claim 1, wherein the vertically aligned or inclined oxygen-evolving anode is actively cooled by the use of at least one or more flow-channels embedded in and/or connected to the anode and/or the anode stem, the flow-channels carrying and circulating a gas coolant.

7. A method in accordance with claim 6, wherein the gas cooling medium is at least one of compressed air, nitrogen, argon, helium, carbon dioxide, and ammonia.

8. A method in accordance with claim 1, wherein the vertically aligned or inclined oxygen-evolving anode is attached to an electrical conductor system through an electric connection, the connection being cooled by heat pipes, liquid cooling and/or gas cooling.

9. A method in accordance with claim 8, wherein the connection is cooled by sodium metal for heat pipes, water, heavy alcohols, oils, synthetic oils, mercury and/or molten salts for liquid cooling and/or compressed air, nitrogen, argon, helium, carbon dioxide, and/or ammonia.

10. A method in accordance with claim 8, wherein the cooling of the electrical connection is obtained by using a highly electrical conductive metal with a large cross sectional area, the area being at least 1.1-5.0 times the cross sectional area of the anode stem cross sectional area.

11. A method in accordance with claim 1, wherein the vertically aligned or inclined anode has an anode stem between the submerged anode and an electrical connection, the stem having a cross sectional ratio to the anode cross section area of at least 0.005-0.5.

12. A method in accordance with claim 1, wherein the vertically aligned or inclined wettable cathode is maintained at a temperature at least at the same level as the electrolyte, the temperature being obtained by use of thermal insulation of the cathode stem.

13. A method in accordance with claim 1, wherein the vertically aligned or inclined wettable cathode temperature is obtained by use of electric resistor heating in an intermediate electric current lead between an electrical connection and the cathode stem.

14. A method in accordance with claim 13, wherein the intermediate electric current lead between the electrical connection and the cathode stem is manufactured from at least one of dense oxidation resistant graphite, a metal and a metal alloy.

15. A method in accordance with claim 1, wherein the vertically aligned or inclined wettable cathode temperature is obtained by reducing the cross sectional area of the submerged cathode compared to the submerged anode area, the cathode area being 0.5-1.0 times the cross sectional area of the submerged anode.

16. A method in accordance with claim 15, wherein the vertically aligned or inclined cathode has a cathode stem between the submerged cathode and an electrical connection, the cathode stem area being 0.005-0.5 times the cross sectional area of the submerged cathode.

17. A method in accordance with claim 1, wherein the vertically aligned or inclined wettable cathode is attached to an electrical conductor system through an electric connection, the connection being cooled by liquid cooling and/or gas cooling.

18. A method in accordance with claim 17, wherein said the electrical connection is cooled using water, heavy alcohols, oils, synthetic oils, mercury and/or molten salts for liquid cooling and/or compressed air, nitrogen, argon, helium, carbon dioxide, and/or ammonia for gas cooling.

19. A method in accordance with claim 17, wherein the cooling of the electrical connection is obtained by using an highly electrical conductive metal with a large cross sectional are, the area being at least 1.1-5.0 times the cross sectional area of the cathode stem cross sectional area.

20. A method in accordance with claim 1, wherein the vertically aligned or inclined cathode has a cathode stem between the submerged cathode and an electrical connection, the stem having a cross sectional ratio to the cathode of at least 0.005-0.05.

21. A method in accordance with claim 1, wherein the vertically aligned or inclined bipolar electrode has an anode surface maintained at a temperature slightly lower than the temperature of the electrolyte and a cathode surface temperature is maintained at a temperature at slightly higher than the electrolyte, the temperatures being obtained by at least one of cooling and heating.

22. A method in accordance with claim 21, wherein the anode of the bipolar electrode is cooled by heat pipes or flow-channels for liquid and/or gas cooling connected to and/or embedded in the anode.

23. A method in accordance with claim 22, wherein the bipolar electrode is cooled using sodium metal for heat pipes, water, heavy alcohols, oils, synthetic oils, mercury and/or molten salts for liquid cooling and/or compressed air, nitrogen, argon, helium, carbon dioxide, and/or ammonia for gas cooling.

24. A method in accordance with claim 22, wherein the heat pipes and/or flow-channels for liquid and/or gas cooling are connected to and/or embedded in the anode.

25. A method in accordance with claim 21, wherein the cathode of the bipolar electrode is heated by inserting a layer of a material with higher electrical resistively that the cathode material between the cathode and the adjacent anode of the bipolar electrode.

26. A method in accordance with claim 15, wherein the cathode of the bipolar electrode is heated by reducing the active surface area of the cathode so that the bipolar electrode has a cathode to anode surface area ratio of at least 0.5-1.0.

27. A method in accordance with claim 14, wherein the at least one of dense oxidation resistant graphite, a metal and a metal alloy is at least one of stainless steel, Incoloy and Hastaloy.

28. A method in accordance with claim 24, wherein the heat pipes and/or flow-channels for liquid and/or gas cooling are connected to and/or embedded in the anode circumference.

* * * * *